US006105605A

United States Patent [19]

Helm et al.

[11] Patent Number: 6,105,605

[45] Date of Patent: Aug. 22, 2000

[54] SYSTEM FOR ROLLING UP HOSES

[75] Inventors: Peter Helm, Maisach; Klaus Ludwig Moser, Wessling, both of Germany

[73] Assignee: Eloma GmbH Grobkuchentechnik, Maisach, Germany

[21] Appl. No.: 09/251,072

[22] Filed: Feb. 16, 1999

[30] Foreign Application Priority Data

Feb. 13, 1998 [EP] European Pat. Off. ..... 98102566

[51] Int. Cl.[7] ..... B65H 75/48

[52] U.S. Cl. ..... 137/355.19; 137/355.23; 137/355.26; 137/580

[58] Field of Search ..... 137/355.23, 355.26, 137/355.19, 900, 580

[56] References Cited

U.S. PATENT DOCUMENTS

| | | | |
|---|---|---|---|
| 1,675,140 | 6/1928 | Schenderlein . | |
| 3,437,105 | 4/1969 | Stracek | 137/355.23 |
| 3,457,946 | 7/1969 | Dean et al. | 137/355.26 |
| 3,822,719 | 7/1974 | Nederman | 137/355.26 |
| 3,865,386 | 2/1975 | Wilke | 251/900 |
| 4,446,884 | 5/1984 | Rader, Jr. | 137/355.23 |
| 4,487,218 | 12/1984 | Sifri | 137/355.23 |
| 5,787,923 | 8/1998 | Shea et al. | 137/580 |

FOREIGN PATENT DOCUMENTS

| | | | |
|---|---|---|---|
| 0 493 736 | 7/1992 | European Pat. Off. | B65H 75/44 |
| 21 10 408 | 9/1971 | Germany | B65H 75/48 |
| 28 50 647 | 6/1980 | Germany | E03C 1/06 |
| 39 01 007 | 7/1989 | Germany | E03C 1/06 |
| 38 12 399 | 10/1989 | Germany | E03C 1/06 |
| 90 05 113 | 1/1991 | Germany | B65H 75/40 |
| 42 42 600 | 2/1994 | Germany | G05G 5/18 |
| 195 05 926 | 8/1996 | Germany | H02G 11/02 |
| 8502159 | 2/1987 | Netherlands | B65H 75/34 |
| 200235 | 12/1938 | Switzerland . | |

*Primary Examiner*—A. Michael Chambers
*Attorney, Agent, or Firm*—Gardner, Carton & Douglas

[57] ABSTRACT

The present invention relates to a hose rolling system for a hose, in particular the hose of a hand shower, through which gaseous or liquid media can be transported, comprising: a hose winding device (1) comprising a hose drum (3) rotatably mounted on an axle (11), a medium supply means (13) arranged at least partially in said axle (11) and comprising an entrance opening (15) and an exit opening (17), connecting means (19) serving to connect said medium supply means (13) with the hose, locking means (21, 23) for locking said hose drum (3) in particular circumferential areas thereof, and spring means (90) impacting said hose drum (3) in the winding direction of the hose and driving said hose drum (3) in winding direction after releasing the locking means, wherein a sealing means (59) is provided which allows for the flow of medium over a particular circumferential area of said axle (11) only and co-operates with said locking means (21, 23) such that the flow of medium is effected only in the area of locking by said locking means (21, 23).

21 Claims, 7 Drawing Sheets

SYSTEM FOR ROLLING UP HOSES

BACKGROUND OF THE INVENTION

The present invention relates to a system for rolling up hoses (hose rolling system).

In particular, the present invention relates to a hose rolling system which is particularly useful for the hose of a hand shower. Hand showers of this kind are made use of in the most various fields. Fields of use are with kitchen appliances, such as steam cooking devices, hot air steam cooking devices and hot air devices, generally with cleaning processes in and outside of the sanitary area, in laboratories, etc.

Both for the supply of additional liquid or other media during the cooking process in kitchen appliances and for the cleaning of kitchen appliances, in particular of large kitchen appliances such as steam cooking devices, hand shower devices are used which serve to supply a gaseous or liquid medium to such devices. This happens preferably by means of a hand shower used by the operator, said hand shower being connected to a hose supplying the medium to the hand shower.

The operator operates the hand shower and squirts out for instance the kitchen appliance in all its edges and angles to clean it completely. Or, liquid is for instance sprayed additionally into the cooking space for the sake of rinsing the cooked products after the cooking process. In order to arrive at the respective places to be cleaned or at other places, it is necessary that the hand shower connected to a hose can be moved to all areas of the kitchen appliance, which requires a corresponding length of the hose.

It is desirable that the hose is accommodated in a space-saving way and that it may be stowed away also in a space-saving way once the cleaning process has been finished.

Hose rolling systems are known in the prior art. U.S. Pat. No. 1,675,140 discloses a hose rolling system comprising a hose drum on which the hose is wound up correspondingly. Via a supply duct the liquid is radially introduced into an axle and is transferred axially from this axle to the wound up hose. A locking device is connected to the hose drum, said locking device making the hose drum lock at two places by means of two cam elements, each of which is provided with a nose. Furthermore, the prior art hose rolling system comprises spring means impinging on the hose drum in the direction of unwinding of the hose and driving the hose drum in the direction of winding up after the locking device has been released.

EP-A-493 736 also discloses a hose rolling system wherein circumferential locking means are provided which, in engagement with cams, can have corresponding locking conditions generated. The hose drum also is impinged on by spring means in particular in the shape of a helical spring in the direction of winding up of the hose, and a winding up of the hose is enabled by releasing the locking device.

The prior art systems are disadvantageous in particular for the facts that they are not only configured of many components and thus are expensive to produce, but also since they do not allow for a targeted dispensing of the medium contained in the hose. Another disadvantage is that, due to the permanently existing pressure of the medium in the hose, possibly occurring leaking may result in major to very large damages in an unobserved condition when for instance a liquid may escape in an unhindered way for several hours.

It therefore is the object of the present invention to provide a hose rolling system for a hose, comprising a device for winding up the hose, in which the medium supplied can only be dispensed in particular operating conditions of the hose winding device, and in which the supply of the medium is blocked at rest.

This object is solved by the features of claim 1.

SUMMARY OF THE INVENTION

In accordance with the present invention, a sealing means is provided which allows for the flow of medium over a particular circumferential area of the axle of the hose rolling system only, so that it is advantageously achieved that the dispensing of the medium, in particular the dispensing of liquid, is effected with a stationary hose winding drum only.

This results in a clearly defined operating position of the hose and prevents in particular unintended re-winding of the hose in operation.

Since the system is not in locking engagement in the wound up condition, a blocking effect of the medium is safely achieved.

Additionally, the hose rolling system according to the invention is of a particularly simple and compact construction and therefore may be put into practice in a correspondingly space-saving and inexpensive way.

Advantageously, a particularly simple configuration of the supply of the desired medium is achieved by the fact that the axle comprises a cut which is in communication with an axial channel in the axle. This has, additionally, advantages with respect to production technology since it is correspondingly simple to make such a cut.

For the effective positioning of the sealing means, the axle comprises circumferential grooves at both sides of the cut.

According to a preferred embodiment, the sealing means of the hose rolling system of the invention comprises two concentric rings which are connected to two connecting bars.

Advantageously, the connecting bars are arranged symmetrically to the centre or to the central axis, respectively, of the concentric rings.

The result thereof advantageously is that the connecting bars can be accommodated in two incorporating units extending in axial direction of the axle and configured as grooves in the proximity of the cut. This enables an effective circumferential and sectoral sealing effect.

Advantageously, the cross-section of the rings of the sealing means is configured substantially circular, which results in a particularly effective sealing effect.

For easy assembly of the axle and alignment of the axle in the interior of a housing surrounding the hose rolling system, the axle comprises a flattening of the outer circumference in the area of the one end portion thereof. This makes it possible to determine the position of the axle and to thus define a blocking of the medium.

Advantageously, the flattening shows the position of the cut or of the axial escape opening, respectively, of the medium supply device.

The locking device of the hose rolling system according to the invention preferably is formed of a gear rim portion and a locking cam being engageable with the gear rim portion and being again detachable thereof.

Advantageously, the gear rim is configured substantially semi-circular, so that locking of the hose drum is enabled over half the circumference thereof.

For a particularly slight and nevertheless robust construction, which additionally is particularly advantageous with respect to assembling technology, the gear rim is formed single-piece with the hose drum.

The connecting means serving to connect the hose to be wound up is, in accordance with the invention, configured as a sleeve rotatable on the axle, comprising a corresponding hose connecting element.

In a particularly preferred embodiment, the connecting means is formed single-piece with the hose drum. Furthermore, a bushing is provided, around which the connecting means extends and together with which it rotates around the axle.

Alternatively, the connecting means comprises a connecting element for connection with the hose drum. This connecting element advantageously may be configured in the form of a substantially circular or flattened plate. This plate then is connected with the hose drum for instance by means of screws or other fixing elements.

A particularly compact construction of the hose rolling system according to the invention is achieved by the fact that the hose drum furthermore comprises the outer coupling of the spring means.

Advantageously, the helically configured spring means is coupled at the inner coupling portion thereof to the axle of the hose winding device. Thus, a simple and space-saving configuration of the individual elements of the hose rolling system results. This space-saving construction is advantageously increased by the fact that the spring means is positioned inside the hose drum.

Advantageously, the inner coupling means of the axle is configured cam-shaped and additionally comprises a plurality of cams.

Particularly advantageously, the cam(s) is/are inclined in counterpressure direction of the spring means, so that a sliding of the inner end of the spring means over one cam to the next one on overload is enabled corresponding to an overstretching contrary to the intended tensioning direction. Advantageously, a disadvantage often occurring with helical springs is avoided therewith, namely that an over-turning of the helical spring in the other direction, which is possible in the case of hose rolling systems of this kind, is avoided, and the break of the helical spring usually occurring then is avoided.

Further details, features and advantages of the invention result from the following description of an embodiment making reference to the drawing.

DETAILED DESCRIPTION OF THE INVENTION

Figure 1:
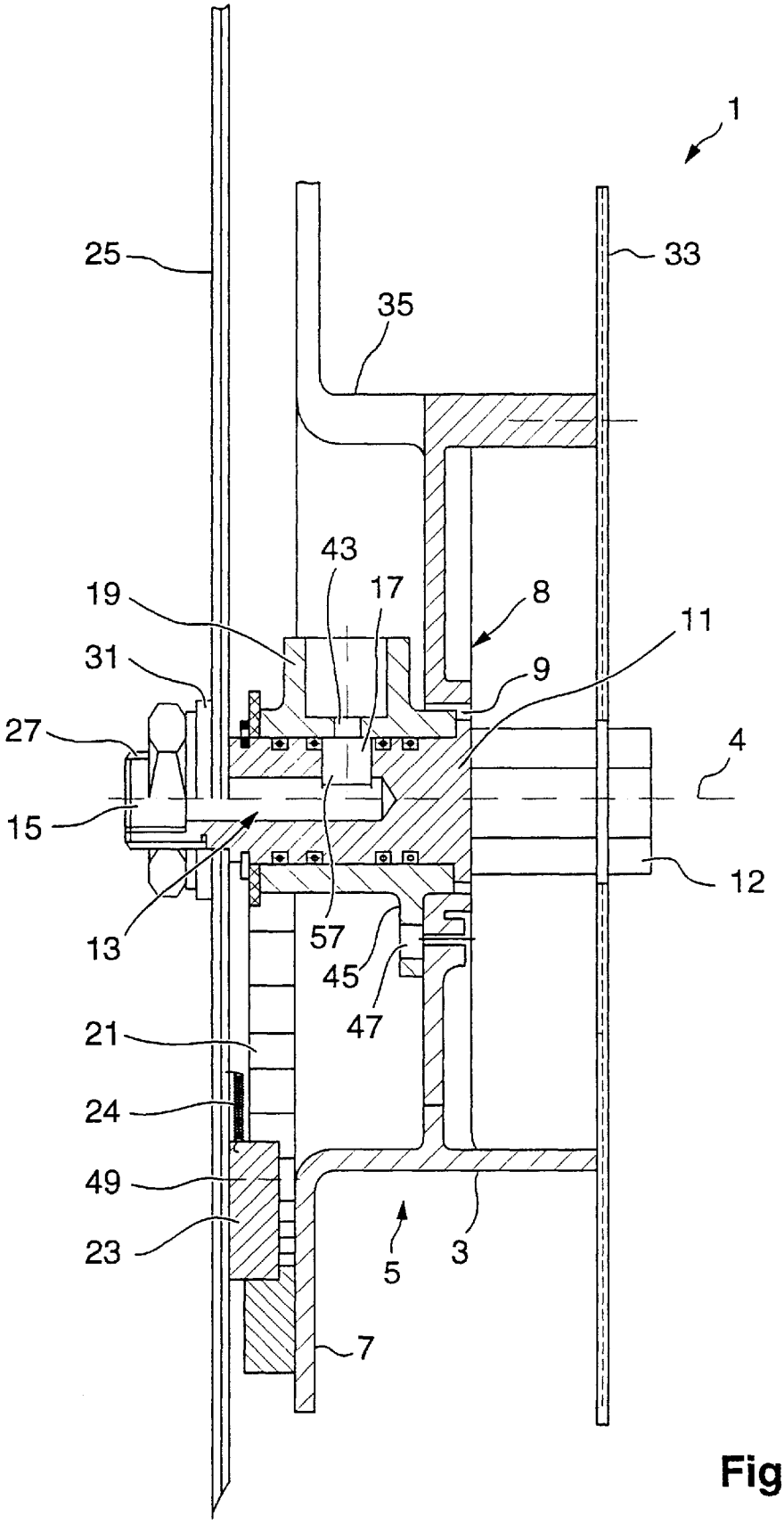
FIG. 1 shows a sectional view through the hose rolling system according to the invention.

In the following, an embodiment of the hose rolling system according to the invention is described. The identical elements represented in the drawing are indicated by the same reference numbers in each case.

FIG. 1 shows a sectional view of a hose rolling system 1 according to the invention. This hose rolling system comprises a hose drum 3 comprising a winding body 5 and a radially extending side wall 7. The hose drum rotates about its axis of rotation 4.

In the central area, the hose drum 3 comprises a hub portion 8 with a passage opening 9 through with an axle 11 extends. The axle will be described in detail making reference to FIG. 9.

A supply means 13 of the medium, such as for instance water, is configured in the axle 11.

This supply means 13 comprises an entrance opening 15 and an exit opening 17.

Around the axle 11 a connecting means 19 is arranged serving, on the one hand, to connect the hose to be wound up (not illustrated) with the supply means 13 and, on the other hand, to care for the connection with the hose drum 3 which is arranged around the axle 11 without touching it.

Furthermore, the hose rolling system according to the invention comprises a gear rim portion 21 configured as locking means, said gear rim portion being connected with the side wall 7.

Figure 7:
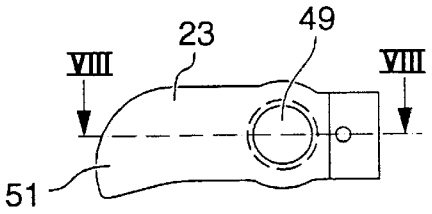
FIG. 7 shows a view on the locking cam.
Figure 8:
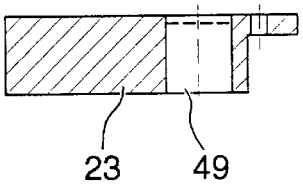
FIG. 8 shows a sectional view of the locking cam in accordance with line VIII—VIII of FIG. 7.

The gear rim portion 21 is in engagement with a locking cam 23 which is illustrated in detail in FIGS. 7 and 8. The locking cam 23 is mounted swivelling at a housing wall 25.

The outer portion of the end portion of the axle 11 comprising the entrance opening 15 comprises a thread 27 serving to accommodate a nut 29. For safeguarding the position of the axle, a distance ring 31 is provided at the housing, against which the nut can be fixed.

The hose drum 3 comprises at the opposite end thereof an axial covering 33 serving to laterally hold the hose.

The hose is guided to the connecting means 19 through an opening 35.

Figures 2, 3:
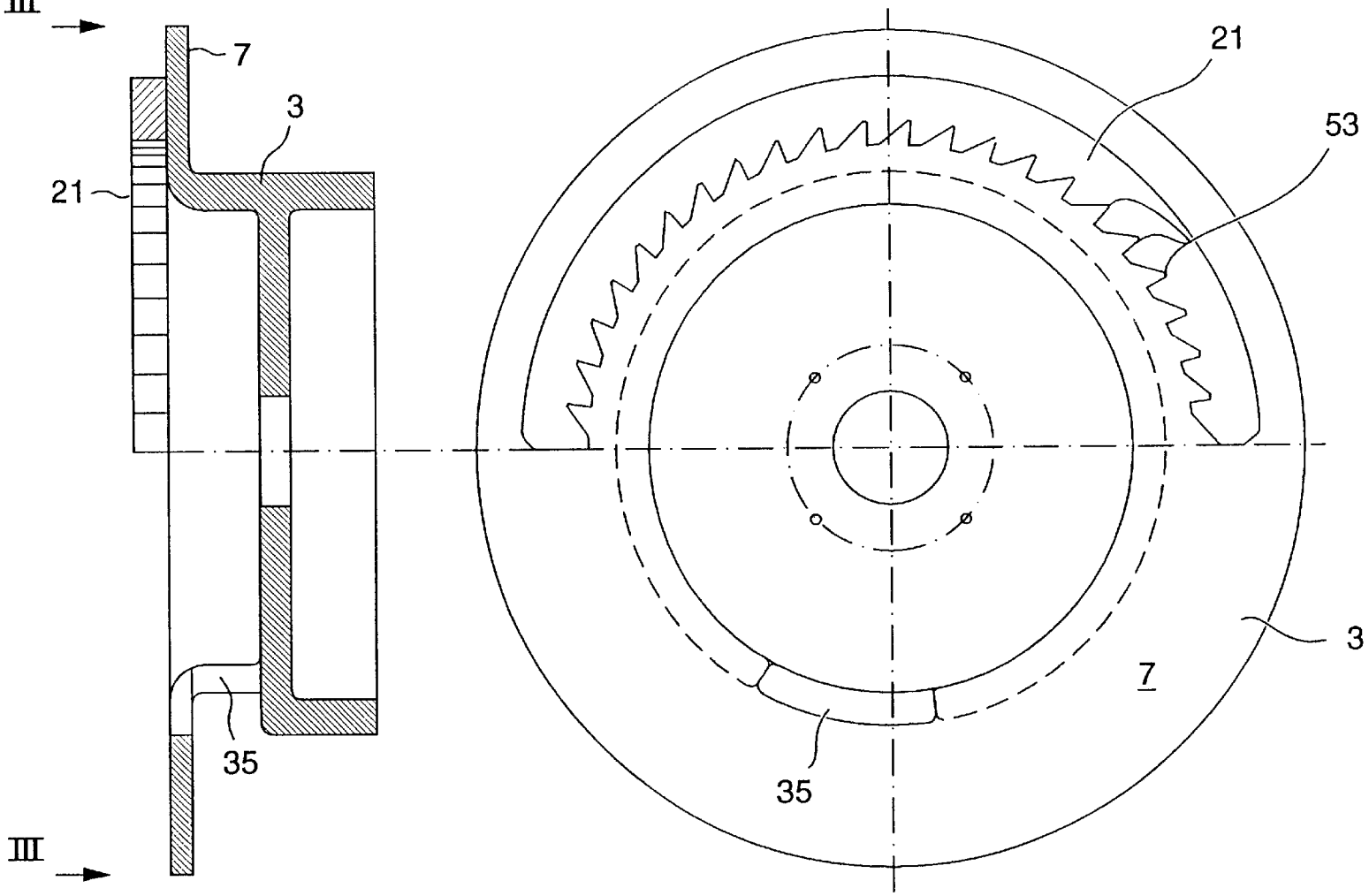
FIG. 2 shows a sectional view through the hose drum with a locking means.
FIG. 3 shows a view in accordance with line III—III of FIG. 2.

FIG. 2 is a sectional view of the hose drum 3. As may be gathered, the gear rim portion 21 is positioned at the portion of the side wall 7 being opposite to the opening 35.

As may be gathered from FIG. 3, the gear rim portion 21 extends substantially semi-circular, i.e. along half of the circumference of the hose drum.

Figure 4:
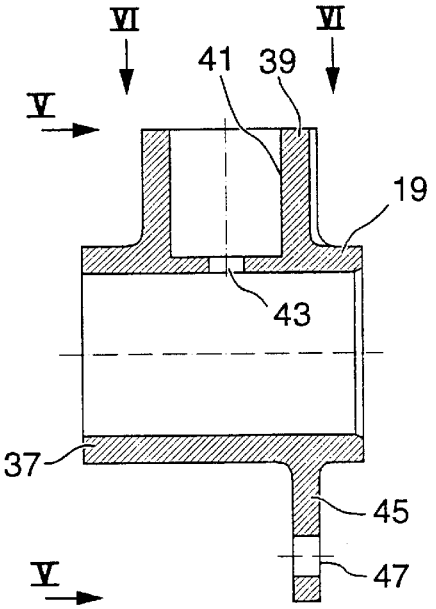
FIG. 4 shows a sectional view through the connecting means.

FIG. 4 is a sectional view of the connecting means 19. This connecting means comprises a sleeve 37 and comprises a connecting element 39 for the hose. The connecting element 39 is configured in the form of a connecting piece and comprises a bore 41 in the form of a blind hole.

Furthermore, a passage opening 43 is provided, which is to generate a connection between the medium supply and the hose or the hand shower fixed thereto, respectively (not illustrated).

Figure 5:
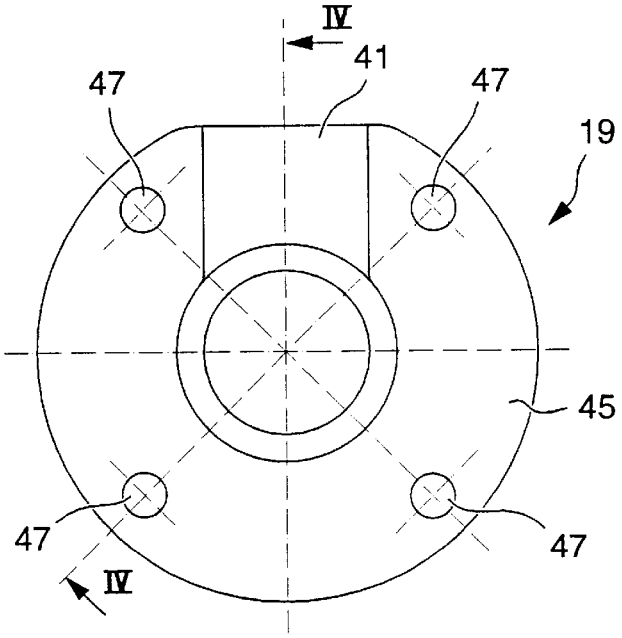
FIG. 5 shows a view in accordance with line V—V of FIG. 4.

As becomes more clear from FIG. 5, the connecting means 19 comprises a plate-shaped connecting element 45 which is configured approximately circular.

Four bores 47 are distributed regularly over the circumference at a distance of 90°, through which suitable connecting means can be passed which serve for a connection with the hose drum 3.

Figure 6:
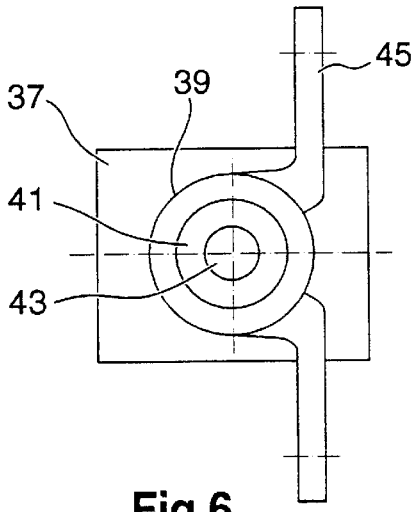
FIG. 6 shows a view in accordance with line VI—VI of FIG. 4.

FIG. 6 shows the view in accordance with line VI—VI of FIG. 4.

FIG. 7 shows the side view of the locking cam 23. This locking cam is mounted rotatably on an axle 49 and comprises a cam-shaped end portion 51.

FIG. 8 shows a sectional view in accordance with the line VIII—VIII of FIG. 7. The cam-shaped end portion 51 serves to engage the index notch 53 of the gear rim portion 21 (FIGS. 1 to 3). The co-operation results as follows.

On unwinding the hose, the hose drum 3 with the stationary index notch 53 is moved relative to the stationary housing 25 and the locking cam or notch lever 23 fixed thereto which is rotatable and resiliently mounted. For the resilient mounting, a helical spring 24 is provided which is fixed to the housing wall 25. The notch lever 23 thus is capable of swivelling in both directions about its axle 49.

The notch lever 23 meets the locking cam 53, makes a swivelling movement and locks first of all in the first index notch. On further rotation of the hose drum 3, the notch lever 23 locks in the following index notch, this causing a distinct rattling noise. With every possibility of locking, a turning back of the hose drum 3 in winding up direction is prevented.

Having passed the gear rim portion 21, the notch lever 23, due to the spring 24, turns back to its starting position perpendicular to the axis of rotation 4 of the hose drum 3.

On turning back of the hose drum 3 in winding up direction of the hose, the notch lever 23 swivels to the other direction and slides with its outer face 52 over the locking cams 53 without a possibility of locking occurring. The hose thus is wound up completely.

Figure 9:
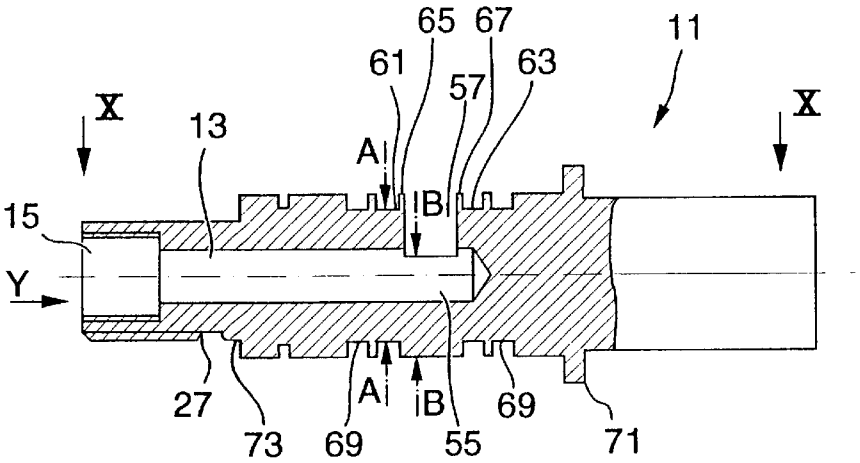
FIG. 9 shows a partial sectional view of the hose rolling system axle.

FIG. 9 shows a partial sectional view of the axle 11 of the hose rolling system. From one end of the axle, a blind hole bore 55 extends centrally, which serves as supply means 13.

Figure 12:
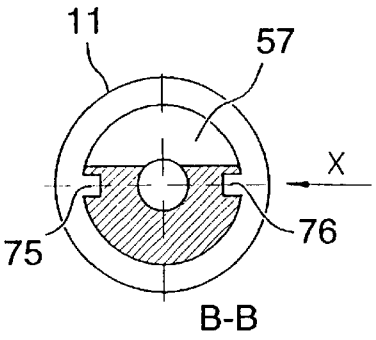
FIG. 12 shows a sectional view in accordance with B—B of FIG. 9.
Figure 13:
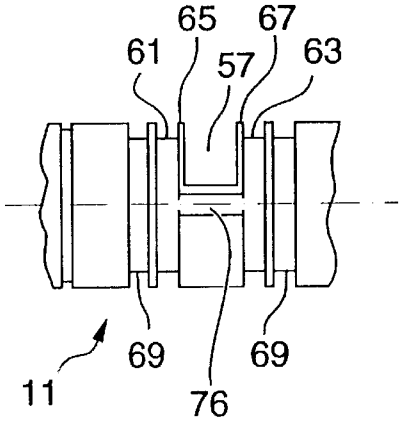
FIG. 13 shows a view of the central area of the hose rolling system axle in the same viewing direction as FIG. 9.

In a central area of the axle 11, a cut 57 is provided from the upper side illustrated in FIG. 9, which is clearly also illustrated in FIG. 12 and in FIG. 13. The cut reaches, as can be seen, down to the area of the blind hole 55, so that a connection or a passage, respectively, for the medium is provided here.

For accommodating the sealing means 59 explained later on making reference to FIGS. 18 to 20, circumferential grooves 61 and 63 are provided, with only thin bars 65 and 67 being arranged at the edge of the cut 57 between the circumferential grooves 61 and 63.

Figure 10:
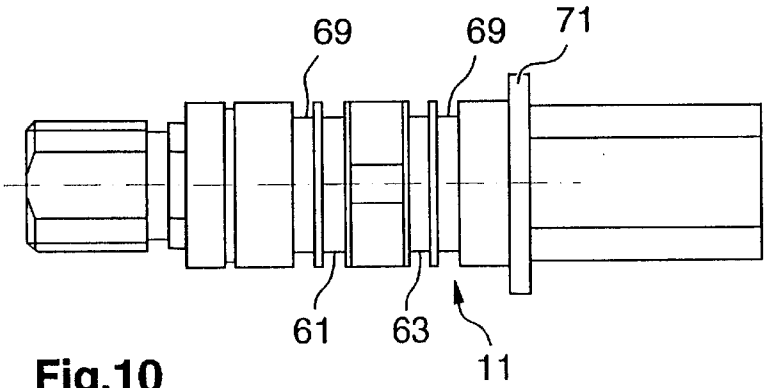
FIG. 10 shows a view in accordance with line X—X of FIG. 9.

As can furtheron be seen clearly from FIGS. 9, 10 and 13, further auxiliary grooves 69 are provided, which may serve to accommodate further sealing rings.

The axle 11 further comprises a stop rib 71, and comprises a step 73 serving the abutment on the housing wall 25 (FIG. 1).

Figure 11:
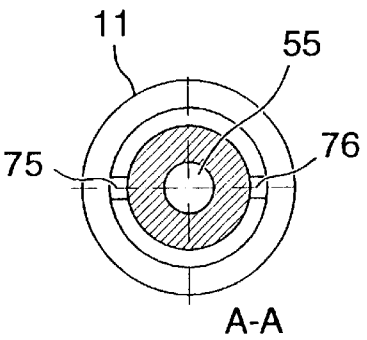
FIG. 11 shows a sectional view in accordance with A—A of FIG. 9.

As may be gathered from FIGS. 11, 12 and 13, axial grooves 75 and 76 are further provided, which also serve to accommodate a sealing.

Figure 14:
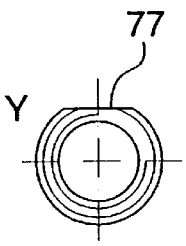
FIG. 14 shows a view onto the hose rolling system axle in accordance with FIG. 9 in the direction of arrow Y.

FIG. 14 shows the view in accordance with the arrow Y of FIG. 9. For determining the position of the cut 57, a flattening 77 is provided at one end portion of the axle 11, which indicates the position of the cut 57. Moreover, the flattening 77 may, however, also co-operate with a corresponding counterface in the distance ring 31 (FIG. 1), so that the correct arrangement of position of the cut is always effected relative to the housing and the locking cam 23 positioned there once the distance ring 31 has been assembled correctly.

Figure 15:
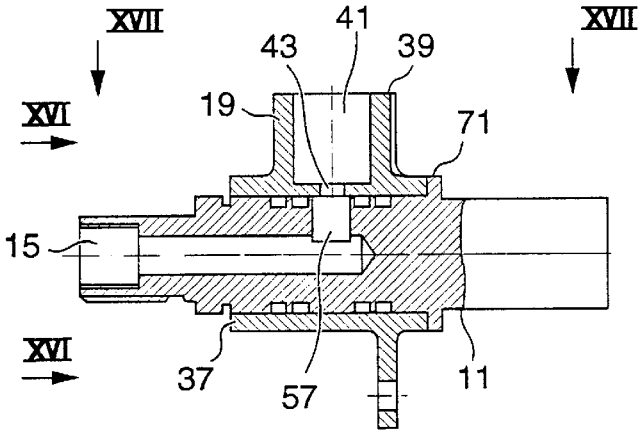
FIG. 15 shows a sectional view of the combined parts of hose rolling system axle and connecting means.
Figure 16:
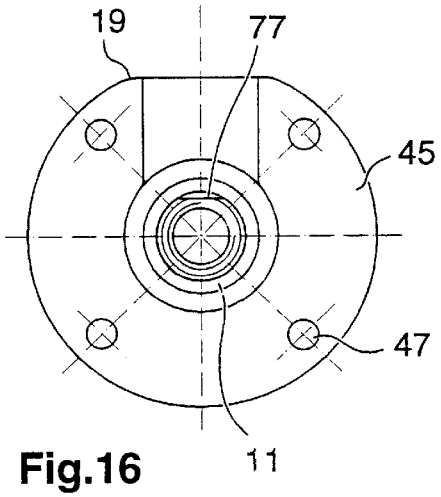
FIG. 16 shows a view in accordance with line XVI—XVI of FIG. 15.
Figure 17:
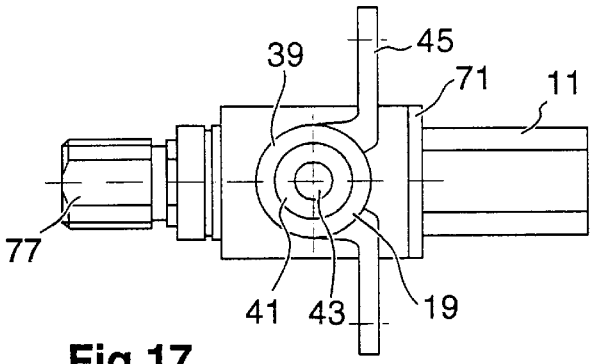
FIG. 17 shows a view in accordance with line VII—VII of FIG. 15.

FIG. 15 illustrates a partial assembly of the axle 11 with the connecting means 19. FIG. 16 shows a view in accordance with line XVI—XVI of FIG. 15, and FIG. 17 shows a view in accordance with line XVII—XVII of FIG. 15. As may be gathered from FIGS. 15 and 17, the sleeve 37 abuts on the stop rib 71.

Figure 18:
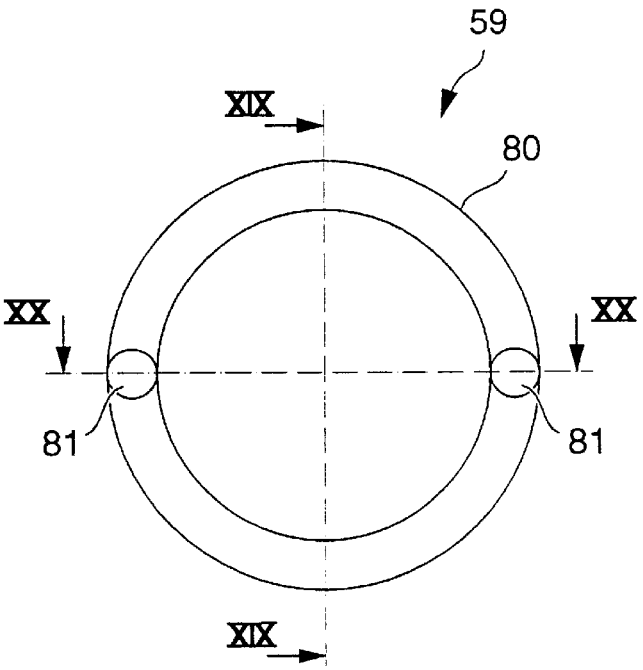
FIG. 18 shows a side view of the sealing means.
Figure 19:
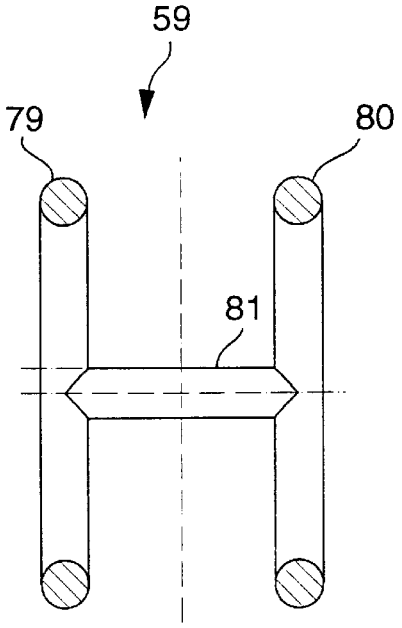
FIG. 19 shows a sectional view in accordance with line XIX—XIX of FIG. 18.
Figure 20:
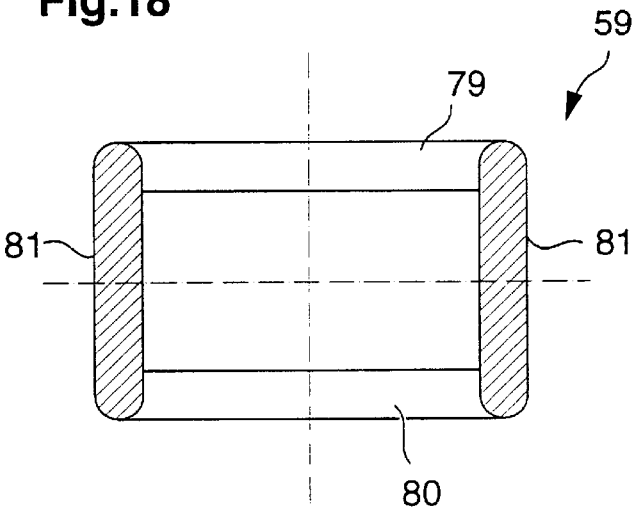
FIG. 20 shows a sectional view in accordance with line XX—XX of FIG. 18.

In FIGS. 18 to 20, the sealing means 59 of the hose rolling system according to the invention is illustrated on a distinctly enlarged scale. The sealing means 59 comprises two sealing rings 79 and 80 of equal size which have a substantially circular cross-section. Two connecting bars 81 connect the two rings 79 and 80. They are arranged substantially in one plane, the sectional plane XX—XX of FIG. 18.

The sealing may be configured of a conventional material such as for instance caoutchouc, silicone or the like.

The connecting portions 81 are accommodated after the assembly of the sealing means 59 in the grooves 75 and 76 of the axle 11. Once this is the case, the connecting portions 81 circumferentially lock the upper portion from the lower portion, as may be gathered from FIG. 12. In operation, the passage of a medium can occur in any position of the passage opening 43 in the upper partial area of the axle 11, i.e. in the area of the cut 57. Simultaneously, the gear rim portion 21 is located in the area of the locking cam 23, so that a transport of medium into the hose may be effected over a substantially semi-circular portion in every locking position.

In the lower portion illustrated in FIG. 12, a sealing then exists by the connecting portions 81, so that no passage of medium whatsoever can occur to the connecting opening 43 passing by the connecting portions.

Figure 21:
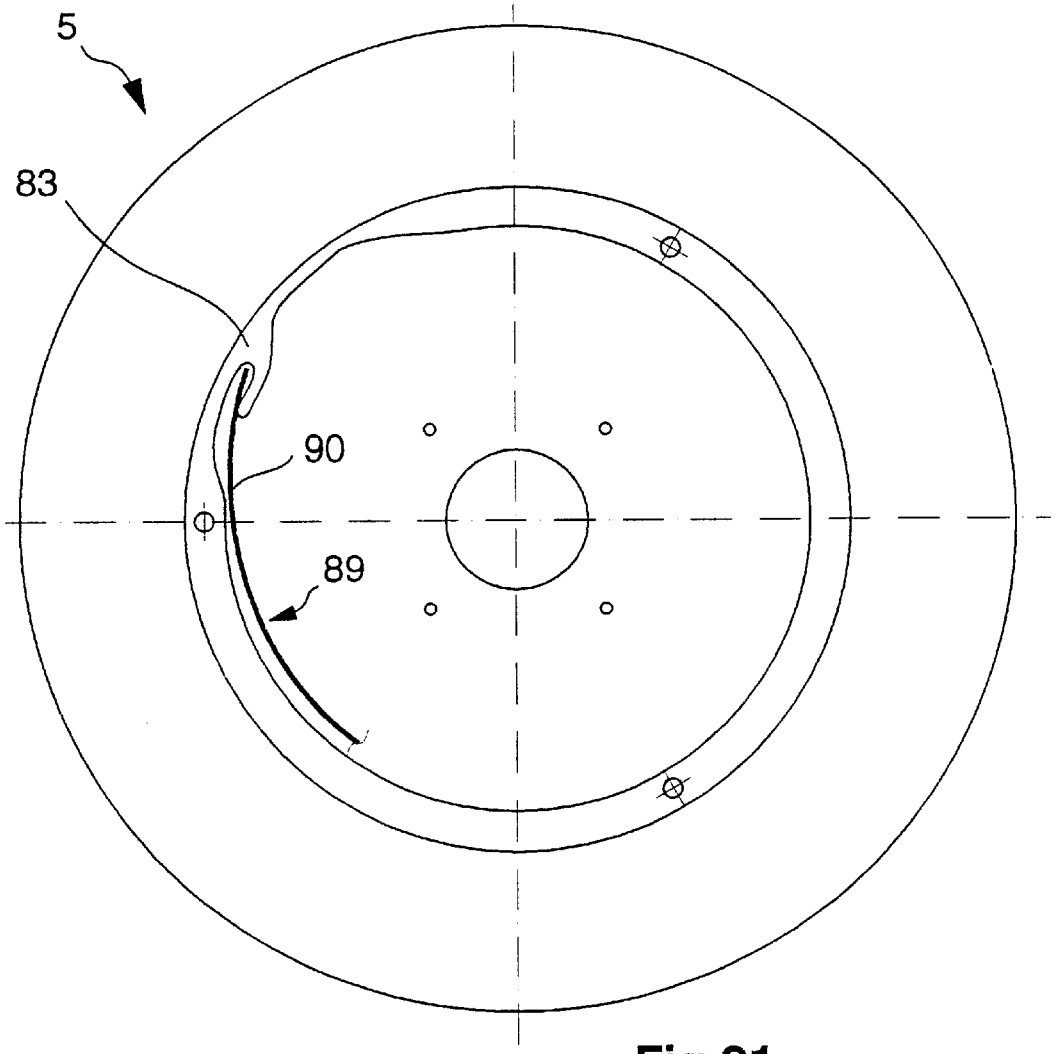
FIG. 21 shows a view on the outer coupling means of the spring means.

FIG. 21 shows a view of the fitting space of a spring means 89. It is positioned in the interior of the winding body 5 and thus increases the space-saving and compact construction of the hose rolling system according to the invention. The outer end of a helical spring 90 (only illustrated in this area) is coupled in a coupling means 83.

Figure 22:
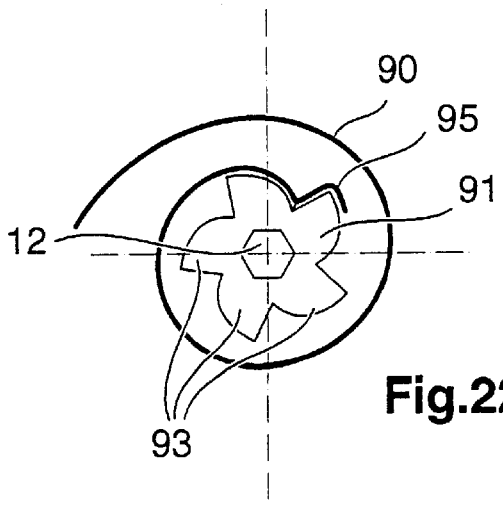
FIG. 22 shows a side view on an inner coupling means of the spring means.

FIG. 22 shows the inner coupling means 91 of a conventionally used helical spring 90 which serves as spring means 89.

In accordance with the invention, the coupling means 91 is configured cam-like and comprises a plurality of cams 93.

Preferably, the cams 93 are slightly inclined in the direction of pressure of the helical spring (clock-wise in the illustrated example). Due to this fact, the coupling end portion 95 of the helical spring 90 may jump on to the next or the next but one cam 93 when the spring is tensioned in counter-direction, so that breaking of the spring is avoided.

The coupling means 91 is put on the end of the axle 12 configured hexagonally in the example (cf. also FIG. 1) and is positioned rotation-proof due to the hexagonal profile.

Based on the above explanations, it is in particular the following advantages that result for the present invention:

slight and compact construction of the hose rolling system;

easy assembling of the few individual parts of the hose rolling system;

safeguarding of the medium transport only in the locked condition of the hose drum;

one-piece sleeve-hose drum configuration;

possibility of locking over a large area without the necessity of exactly addressing an index notch;

security against break of the drive spring coupling.

What is claimed is:

1. A hose rolling system for a hose through which gaseous or liquid media can be transported, comprising:

a hose winding device comprising a hose drum mounted on an axle, a medium supply means arranged at least partially in said axle and comprising an entrance opening and an exit opening, connecting means serving to connect said medium supply means with the hose, locking means for locking said hose drum in particular circumferential areas thereof, and spring means impinging on said hose drum in the winding direction of the hose and driving said hose drum in said winding direction after releasing the locking means, and sealing means which allows for the flow of medium over a particular circumferential area of said axle only and co-operates with said locking means such that the flow of medium is effected only in the area of locking by said locking means.

2. The hose rolling system in accordance with claim 1, wherein said axle comprises a cut communicating with an axial channel in said axle.

3. The hose rolling system in accordance with claim 2, wherein said axle comprises circumferential grooves at both sides of said cut, serving to accommodate said sealing means.

4. The hose rolling system in accordance with claim 1, wherein said sealing means is formed of two rings having substantially the same size, and comprises two connecting portions for connecting said two rings.

5. The hose rolling system in accordance with claim 4, wherein said connecting portions are arranged symmetrically to the central axis of said two rings.

6. The hose rolling system in accordance with claim 5, wherein two grooves extending in axial direction of said axle are provided in the proximity of said cut for accommodating said connecting portions.

7. The hose rolling system in accordance with claim 4 wherein the cross-section of said rings of said sealing means is substantially circular.

8. The hose rolling system in accordance with claim 1, wherein said axle comprises a flattening at the outer circumference in the area of the one end portion thereof.

9. The hose rolling system in accordance with claim 8, wherein said flattening corresponds to the position of said cut or of the axial exit opening of said medium supply means, respectively.

10. The hose rolling system in accordance with claim 1 wherein said locking means comprises a gear rim portion and a locking cam.

11. The hose rolling system in accordance with claim 10, wherein said gear rim portion is configured substantially semi-circular.

12. The hose rolling system in accordance with claim 10, wherein said gear rim portion is formed single-piece with said hose drum.

13. The hose rolling system in accordance with claim 1, wherein said connecting means is a sleeve rotatable in said axle, which comprises a hose connecting element.

14. The hose rolling system in accordance with claim 1, wherein said connecting means is a sleeve-like body formed single-piece with said hose drum and arranged around a rotating bushing together with which it rotates around said axle.

15. The hose rolling system in accordance with claim 1, wherein said connecting means comprises a connecting element for connection with said hose drum.

16. The hose rolling system in accordance with claim 15, wherein said connecting element is configured substantially as a circular or flattened plate.

17. The hose rolling system in accordance with claim 1, wherein said hose drum further comprises an outer coupling of a spring means in a winding body of the hose drum.

18. The hose rolling system in accordance with claim 17, wherein said spring means is arranged inside said winding body.

19. The hose rolling system in accordance with claim 17 wherein said spring means is helically configured and is coupled in the inner coupling portion thereof to said axle of said hose winding device.

20. The hose rolling system in accordance with claim 19, wherein said inner coupling means of said axle is configured cam-shaped and comprises a plurality of cams.

21. The hose rolling system in accordance with claim 20, wherein said cams are slightly inclined in counterpressure direction of said spring means, so that sliding of the inner end of said spring means over one cam at least to the next one is enabled.

* * * * *